US009873490B2

(12) United States Patent
Day

(10) Patent No.: US 9,873,490 B2
(45) **Date of Patent: *Jan. 23, 2018**

(54) DOOR SYSTEMS AND METHODS FOR BOATS

(71) Applicant: Thomas M Day, Bellingham, WA (US)

(72) Inventor: Thomas M Day, Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/222,781

(22) Filed: Jul. 28, 2016

(65) Prior Publication Data

US 2016/0368575 A1 Dec. 22, 2016

Related U.S. Application Data

(63) Continuation of application No. 14/746,672, filed on Jun. 22, 2015, now Pat. No. 9,409,630.

(51) Int. Cl.

| | |
|---|---|
| ***B63B 17/00*** | (2006.01) |
| ***B63B 27/14*** | (2006.01) |
| ***B63B 21/24*** | (2006.01) |
| ***B63B 21/26*** | (2006.01) |
| *B63B 35/00* | (2006.01) |

(52) U.S. Cl.

CPC ..... *B63B 27/143* (2013.01); *B63B 21/243* (2013.01); *B63B 21/26* (2013.01); *B63B 2035/001* (2013.01)

(58) Field of Classification Search

CPC ..... B63B 27/00; B63B 27/14; B63B 27/143; B63B 2027/00; B63B 2017/14; B63B 2027/143; B63B 21/243; B63B 21/26

USPC ..... 114/60, 70, 72, 116, 117, 230.1, 294, 114/295, 362, 364

See application file for complete search history.

(56) References Cited

U.S. PATENT DOCUMENTS

| | | | | |
|---|---|---|---|---|
| 2,341,866 A | | 2/1944 | Jackson | |
| 2,476,319 A | | 7/1949 | Norris | |
| 2,568,330 A | | 9/1951 | Flippin | |
| 3,468,280 A | | 9/1969 | Williams | |
| 3,846,860 A | * | 11/1974 | Kummerman | B63B 27/143 14/71.1 |
| 3,879,784 A | * | 4/1975 | Kummerman | B63B 27/143 14/71.1 |
| 4,158,416 A | | 6/1979 | Podesta | |

(Continued)

FOREIGN PATENT DOCUMENTS

| | | | |
|---|---|---|---|
| JP | 2002114191 | A | 4/2002 |
| RU | 2041118 | C1 | 8/1995 |
| WO | 2016209709 | A1 | 12/2016 |

OTHER PUBLICATIONS

International Searching Authority, International Search Report and Written Opinion, PCT/US2016/37830, dated Oct. 20, 2016, 7 pages.

*Primary Examiner* — Daniel V Venne

(74) *Attorney, Agent, or Firm* — Schacht Law Office, Inc.; Dwayne Rogge

(57) ABSTRACT

Disclosed herein is a bow ramp for a water vessel (boat) wherein the bow ramp is configured to rotate/pivot to an open position to allow passage from within a hull of the vessel to a shore. The bow ramp is operated in combination with shore penetrating spikes which penetrate a shore or seabed (riverbed, lakebed, etc.) and include a user-actuated spike rotation mechanism which allows a user to move the water vessel further up a shore or alternatively away from a shore.

5 Claims, 8 Drawing Sheets

(56) References Cited

U.S. PATENT DOCUMENTS

| | | | | |
|---|---|---|---|---|
| 4,161,795 | A * | 7/1979 | Quest | B63B 27/14 114/362 |
| 4,293,967 | A | 10/1981 | Ord | |
| 4,681,054 | A | 7/1987 | Rice et al. | |
| 5,191,854 | A | 3/1993 | Lehmann et al. | |
| 6,067,926 | A | 5/2000 | Robinson | |
| 6,223,669 | B1 | 5/2001 | Bowden | |
| 6,792,886 | B1 | 9/2004 | Maloney et al. | |
| 7,621,230 | B1 | 11/2009 | Anderson et al. | |
| 7,712,727 | B1 | 5/2010 | Cole | |
| 2002/0164231 | A1 | 11/2002 | Lucas et al. | |
| 2003/0217681 | A1 | 11/2003 | Funk | |
| 2006/0060128 | A1 | 3/2006 | Bailey et al. | |
| 2007/0163484 | A1 | 7/2007 | Eng et al. | |
| 2014/0158038 | A1 | 6/2014 | Johnston | |

* cited by examiner

DOOR SYSTEMS AND METHODS FOR BOATS

RELATED APPLICATIONS

This application is a continuation of U.S. patent application Ser. No. 14/746,672 filed Jun. 22, 2015, currently pending.

The contents of all related applications are incorporated herein by reference.

BACKGROUND OF THE DISCLOSURE

Field of the Disclosure

This disclosure relates to the field of downward hinged bow ramps for water vessels.

Background

Although some bow ramps have been known in the art of marine vessels, especially landing craft style water vessels, the combination of a bow ramp with user-pivotable spikes has not been known to this point.

To at least partially offset contact with the water 36, landing craft style water vessels are often provided with a bow ramp which in a closed position forms a door, closing an open region of the hull, commonly at the bow. Such bow ramps extend forward and downward so as to bridge the gap between the bow of the water vessel and the shore 42.

SUMMARY OF THE DISCLOSURE

Disclosed herein are examples of a door system or bow ramp for a boat. The system in one example comprising: a vessel having a hull configured to float on the surface of water, the hull comprising a bow and a stern; the bow having a substantially planar bow ramp having a proximal end pivotably attached to the hull at a bow ramp/hull pivot, and a distal end; a user-actuated bow ramp lift mechanism attached between the bow ramp and the hull configured to mechanically manipulate the bow ramp about the bow ramp pivot from a closed position to an open position; at least one spike pivotably attached to the bow ramp at a bow ramp/spike pivot near the distal end of the bow ramp; a user-actuated spike rotation mechanism configured to mechanically manipulate each spike about the bow ramp/spike pivot; and a remote control actuator for each of the user-actuated bow ramp lift mechanism and the user-actuated spike rotation mechanism.

The door system may further comprise feet pivotably attached to each spike. These feet may be removably attached to each spike.

The door system may be arranged wherein the user-actuated spike rotation mechanism configured to mechanically manipulate the spike about the bow ramp/spike pivot comprises a hydraulic actuator.

The door system may be arranged wherein the user-actuated spike rotation mechanism configured to mechanically manipulate the spike about the bow ramp/spike pivot comprises a pneumatic actuator.

DESCRIPTION OF THE PREFERRED EMBODIMENTS

Disclosed herein is a bow ramp for a water vessel (boat) wherein the bow ramp is configured to rotate/pivot to an open position to allow passage from within a hull of the vessel to a shore. Additionally, the use of a user-actuated shore-engaging spike rotation mechanism which allows a user to move the water vessel further up the shore or alternatively away from the shore is also unknown.

Figure 1:
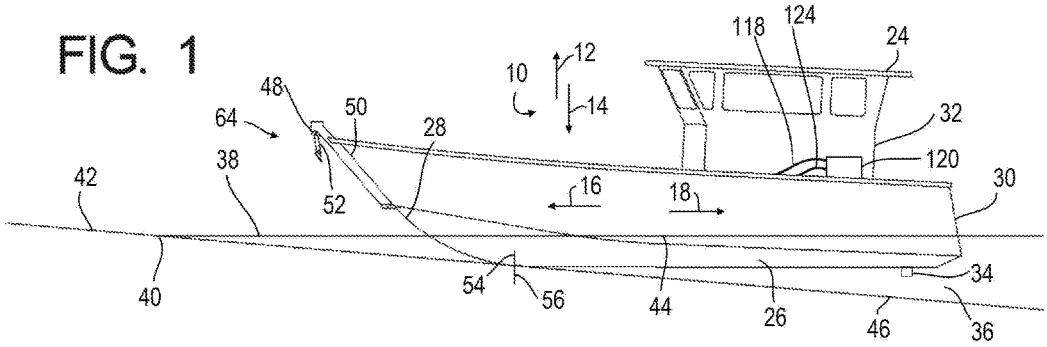
FIG. 1 is a side environmental view of one example of the door system and method for boats with a bow ramp in a closed position.
Figure 9:
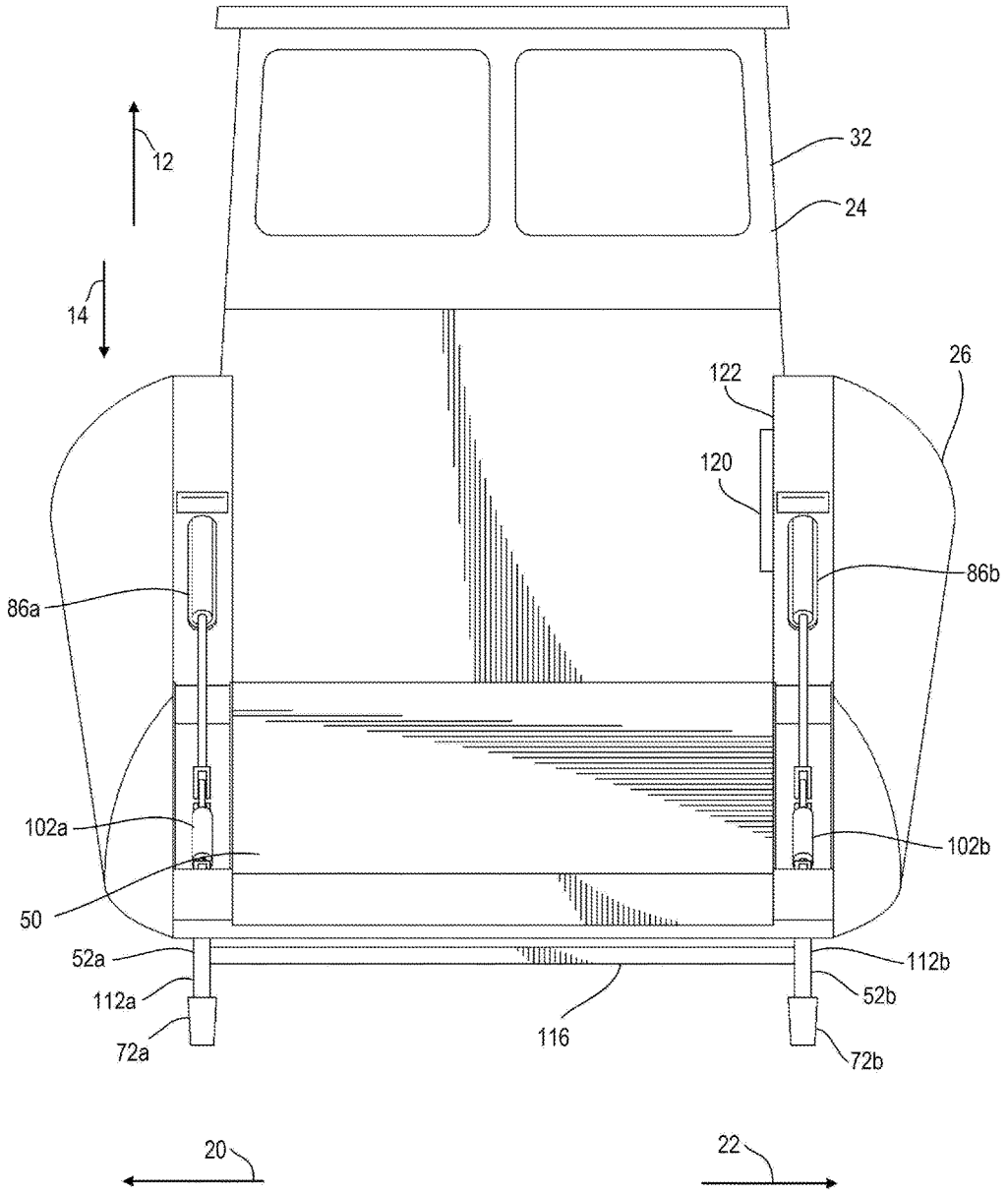
FIG. 9 is a front view of the example shown in FIG. 3.
Figure 10:
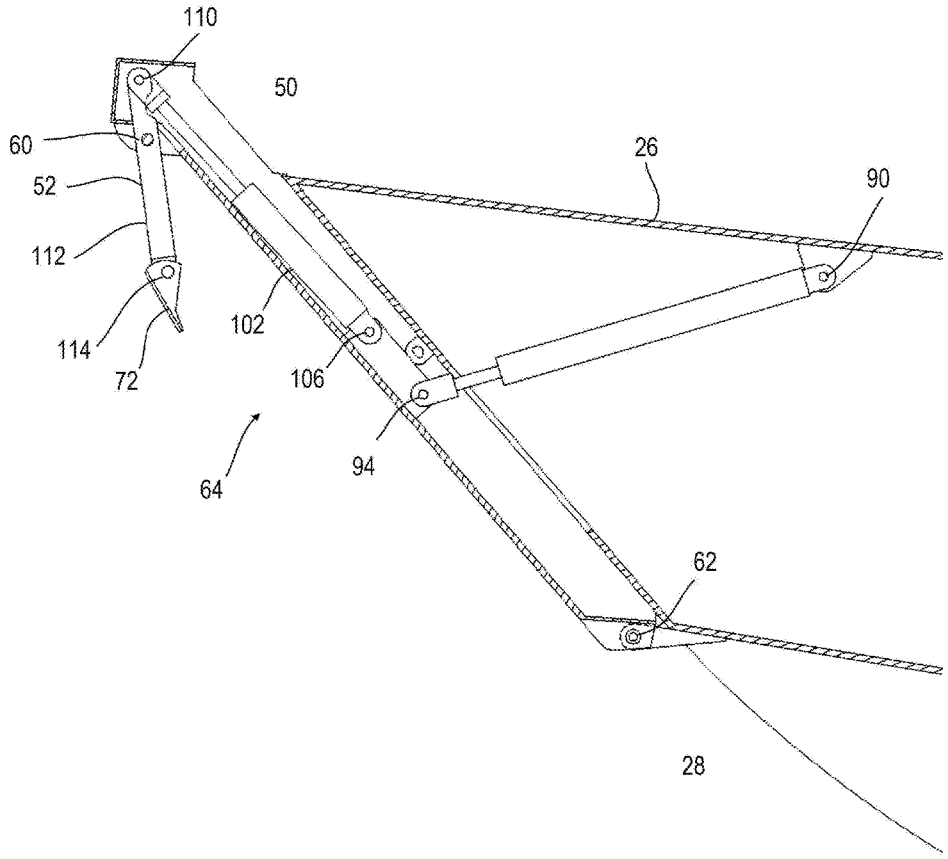
FIG. 10 is a side cutaway enlarged view of the example shown in FIG. 1.

Before continuing a detailed description, an axes system 10 is shown in FIG. 1 comprising a vertical axis including an upward direction 12, and a downward direction 14. In addition, relative to the water vessel is a longitudinal axis including a forward direction 16 and an aft or rearward direction 18. Looking to FIG. 9 is also shown relative to the water vessel a horizontal axis including a starboard direction 20 and a port direction 22. These axes are intended to aid in description of the disclosed examples and are not intended to be a limiting to a particular orientation except where recited in the claims.

Returning to FIG. 2 is shown a water vessel 24 having a hull 26 including a bow region 28 and a stern region 30. The bow region 28 generally defined as the forward 16 region and the stern 30 defined as the aft or rearward region. Many such water vessels 24 have a cockpit 32 (cabin or bridge region) in which is often provided control mechanisms for operating the vessel and accessories. Such control mechanisms generally include controls for a drive system 34 including a screw (propeller/prop), jet or other propulsion mechanism. A steering system may be incorporated into the drive system 34, or may utilize a rudder or similar apparatus separate from the drive system 34.

The water vessel 24 generally floats in a body of water 36 having a surface 38. The surface 38 of the water 36 contacting the shore 42 at a shoreline 40 with the shore 42 defined as the area of land vertically above and generally adjacent the water 36. It is understood that the relative position of the shoreline 40 to the shore 42 moves as waves, tides, etc. effect the surface 38 of the water 36.

The level at which the water surface 38 meets the hull 26 is defined as a waterline 44. The waterline 44 is also generally affected by waves, and the weight and position of persons or cargo within the hull 26. If the hull 26 is resting upon the seabed 46 below the water surface 38, or partially on the shore 42, then the waterline 44 will alter its position on the hull 26.

As a vessel 24 floats upon the water surface 38, at least some portion of the hull 26 must extend into the water 36 below the water surface 38. As a vessel 24 is driven towards the shore 42, the hull 26 will generally contact the seabed 46 prior to the most forward point 48 of the bow crossing a vertical plane extending to the shoreline 40. Thus, passengers or cargo leaving the vessel 24 toward the shore 42 without any sort of bow ramp or gangway, or dock, will often contact the water 36 before achieving the shore 42. This may be detrimental as the passengers, cargo, or handling equipment may get wet. In addition, the underwater seabed 46 may be soft, muddy, etc. Even with such bow ramps, often the distance between the bow of the water vessel and the shoreline 40 is greater than the longitudinal length of the bow ramp and thus such bow ramps may be less than satisfactory.

Disclosed herein is an improvement to such systems which allow a user to manipulate a bow ramp 50 with a plurality of shore penetrating spikes 52. The shore penetrating spikes 52 engage the shore to inhibit movement of the vessel 24 relative to the shore. In one form of the invention, the shore penetrating spikes are capable of moving the water vessel 24 forward 16 towards the shoreline 40, or rearward 18 away from the shoreline without engaging the drive system 34. It is known that engaging such drive system 34 in shallow water near a shoreline 40 is generally detrimental to the drive system 34 due to contact with the seabed or intake of debris into the drive system.

Figure 2:
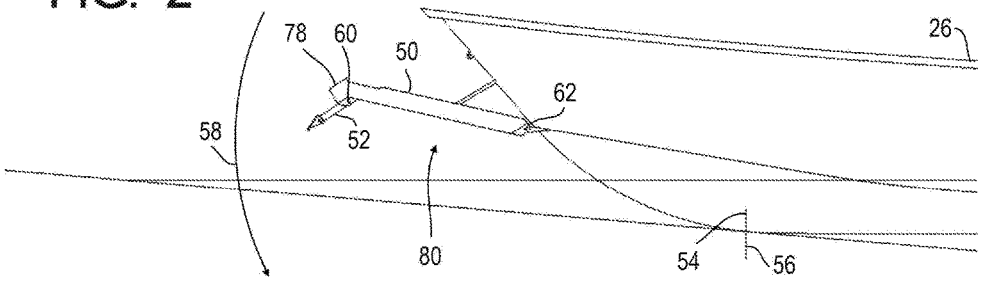
FIG. 2 is a detail enlarged view of the example shown in FIG. 1 with the bow ramp in a partially opened position.

To clearly show horizontal movement of the hull 26 relative to the shoreline 40 as the door system and method for boats is operated, in FIG. 2, an arbitrary hull reference line 54 is shown relative to the hull 26 near the bow 28. An arbitrary shore alignment line 56 is indicated relative to the seabed 46 in line with the hull alignment line 54. These lines are positioned as shown when the hull 26 first contacts the seabed 46 as the vessel 24 approaches the shore 42.

In the example shown in FIG. 1, the bow ramp 50 is in a fully closed position 64 such that the bow ramp 50 is in contact with the bow 28 and substantially prevents water entry between the bow ramp 50 and other portions of the bow 28. The bow ramp 50 thus forms a door closing the front of the bow 28. In this view, the shore penetrating spikes 52 are not extended.

Looking to FIG. 2, the bow ramp 50 is shown partially rotated about a bow ramp/hull pivot 62 in a downward direction of rotation 58 to a partially open position 80. In addition, the shore penetrating spikes are shown rotated forward about a bow ramp/spike pivot 60 to a fully extended position.

Figure 3:
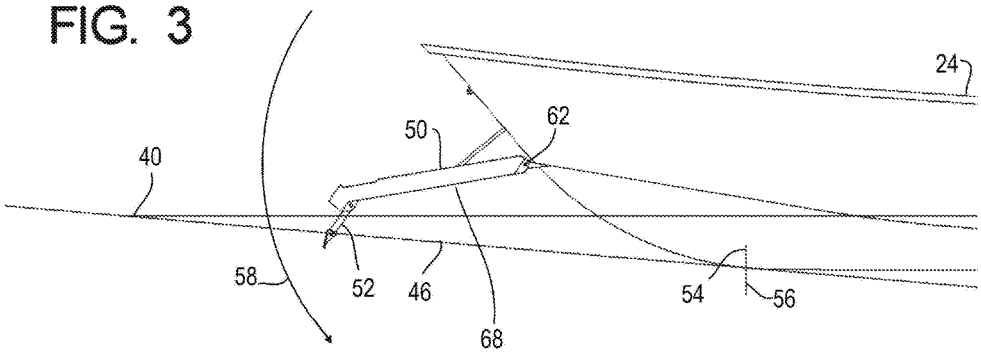
FIG. 3 shows the example of FIG. 2 with the bow ramp in a shore engaging position.

Looking to FIG. 3, the bow ramp 50 has been rotated in the downward direction of rotation 58 about the bow ramp/hull pivot 62 until the shore penetrating spikes 52 have partially penetrated into the seabed 46. In this position, the spikes 52 secure the water vessel 24 to the seabed 46 in relative position to the shoreline 40 and hinder longitudinal and rotational movement of the water vessel relative to the shoreline 40. Without such securing of the water vessel relative to the seabed, waves, wind, tides, and movement of persons and/or cargo within the vessel 24 may reposition the vessel 24 away from the shoreline 40 or rotate the vessel 24 so as to misalign the bow ramp 50 wherein it is no longer pointed toward the closest shore 42. Traditionally, a bar or similar non-movable, protruding portion of the bow ramp 50 is pressed onto the seabed 46 or shore 42 to stabilize the bow ramp as the bow ramp is being traversed.

As shown in FIG. 3, the shore penetrating spikes 52 are shown not inserted fully into the seabed 46. This positon may be utilized in rocky or otherwise hard seabed 46. The feet 72 press horizontally against the seabed to hold the water vessel 24 in position, or laterally move the water vessel 24 when the spikes 52 are rotated.

Figure 4:
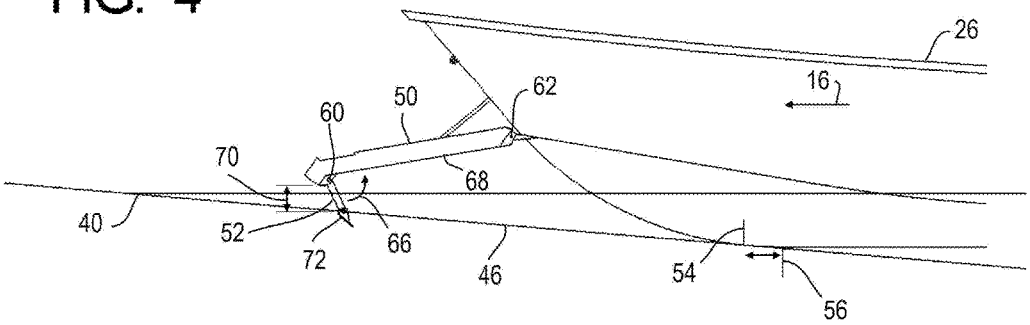
FIG. 4 shows the example of FIG. 3 in with the door system in a pulling operation.

In FIG. 4 the shore penetrating spikes are shown mechanically rotated rearward through arc of rotation 66 relative to the ramp 50 toward the outer surface 68 of the bow ramp 50 from the most forward position shown in FIG. 3. In this example there is a vertical offset 70 between the bow ramp/spike pivot 60 and a foot 72 or distal end of the spikes 52. Thus, rotation of the spikes 52 will result in forward 16 movement of the hull 26 relative to the shoreline 40 as the feet 72 press longitudinally against the seabed 46 or shore 42. This movement can be seen by the horizontal offset 74 between the hull alignment line 54 and the shore alignment line 56.

Figure 5:
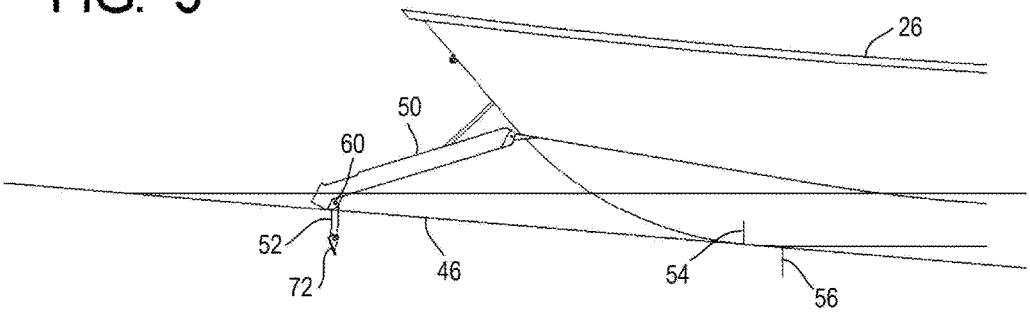
FIG. 5 shows the example of FIG. 4 with shore penetrating spikes in a neutral position.

FIG. 5 shows the spikes 52 fully pressed into the seabed 46 to secure the water vessel 24 in position in relatively soft seabed 46 or when a more secure position is desired. In a soft seabed, such as sand or mud, the penetrating spikes may be rotated when so fully inserted, and the feet 72 may provide sufficient longitudinal resistance to move the vessel longitudinally relative to the shoreline 40 forward 16 or rearward 18.

Figure 6:
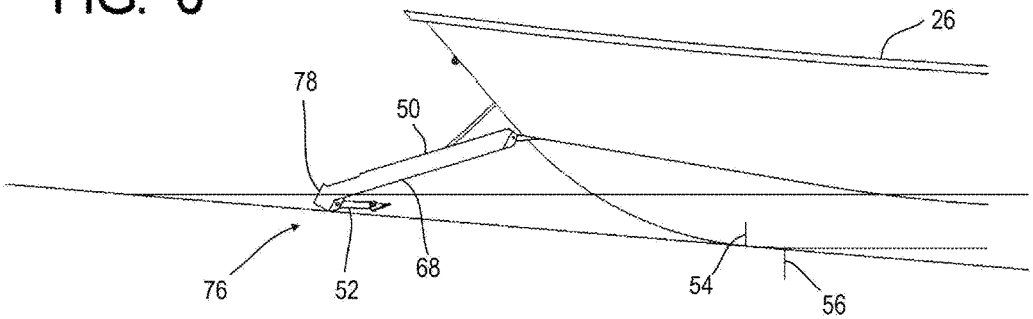
FIG. 6 shows the example of FIG. 5 with the shore penetrating spikes in a fully withdrawn position.

FIG. 6 shows the spikes 52 in a fully withdrawn and retracted position 76 where the spikes 52 are positioned immediately adjacent the outer surface 68 of the bow ramp 50 and pointed away from the distal end 78 of the bow ramp 50. This is the same spike position as shown in FIG. 1.

Figure 7:
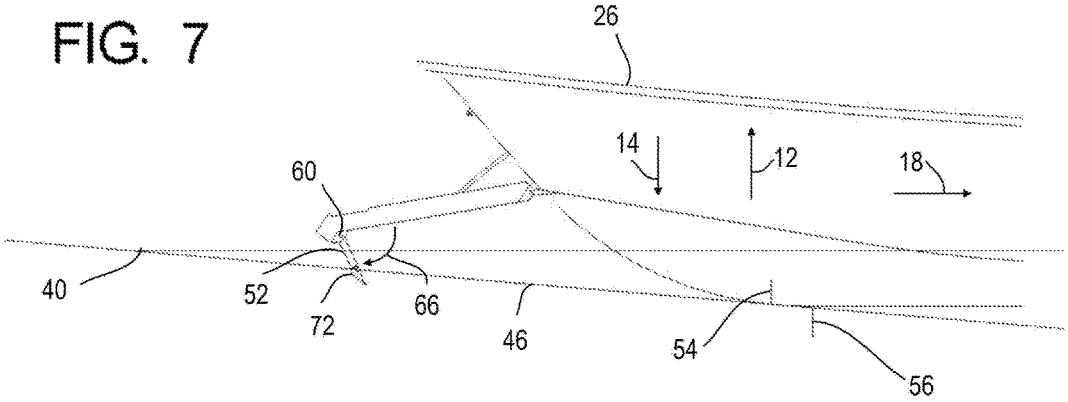
FIG. 7 shows the example of FIG. 6 with the shore penetrating spikes in a pushing operation.
Figure 8:
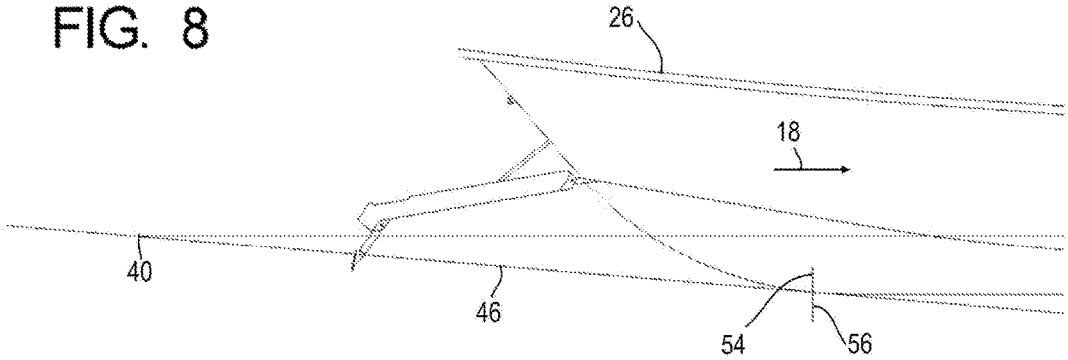
FIG. 8 shows the example of FIG. 7 with the shore penetrating spikes in a fully extended position.

FIG. 7 shows the penetrating spikes 52 rotated in arc of rotation 66 about bow ramp/spike pivot 60 in a rotational direction opposite that shown in FIG. 4. As the spike 52 engages the seabed 46 during this rotation, each foot 72 will push downward 14 and rearward 18 on the seabed 46, thus raising the bow 28 slightly and pushing rearward on the hull 26. As this rotation of the spike 52 continues to the position shown in FIG. 8, the hull 26 will reposition rearward 18 relative to the shoreline 40 as evidenced by the hull alignment line 54 returning to an aligned position with the shore alignment line 56.

Either of these operations; that of drawing the hull 26 further onto the shore 42, or pushing the hull 26 further from the shore 42, may be repeated as often as necessary to achieve the desired position of the vessel 24 relative to the shoreline 40.

Figure 11:
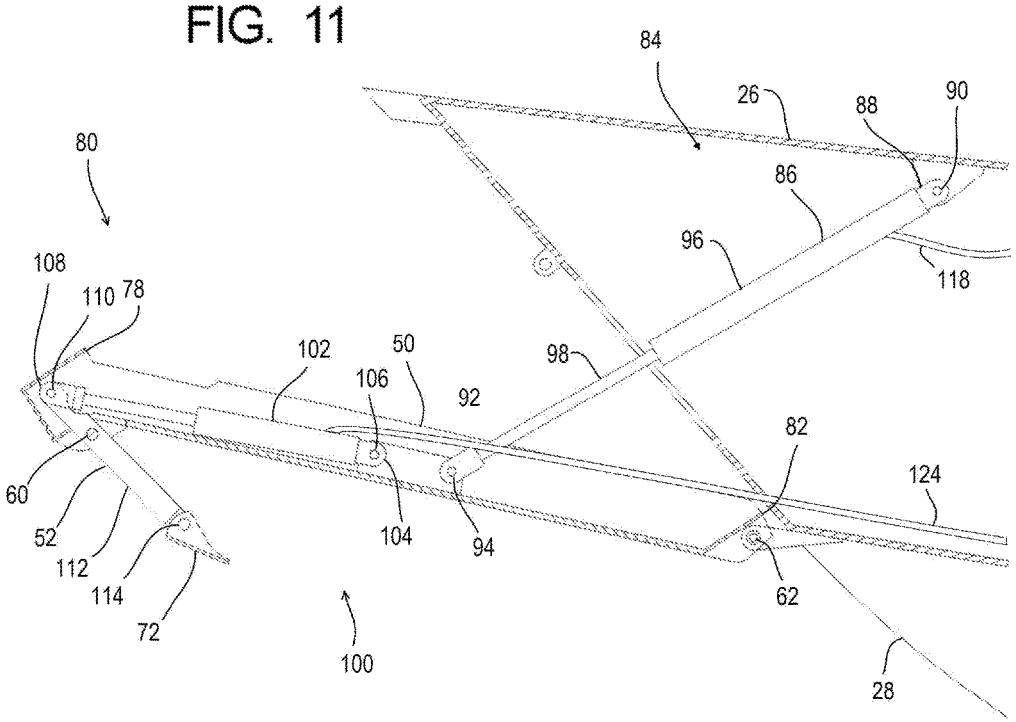
FIG. 11 is a side cutaway view of the example shown in FIG. 10 with the bow ramp in a partially opened position.
Figure 12:
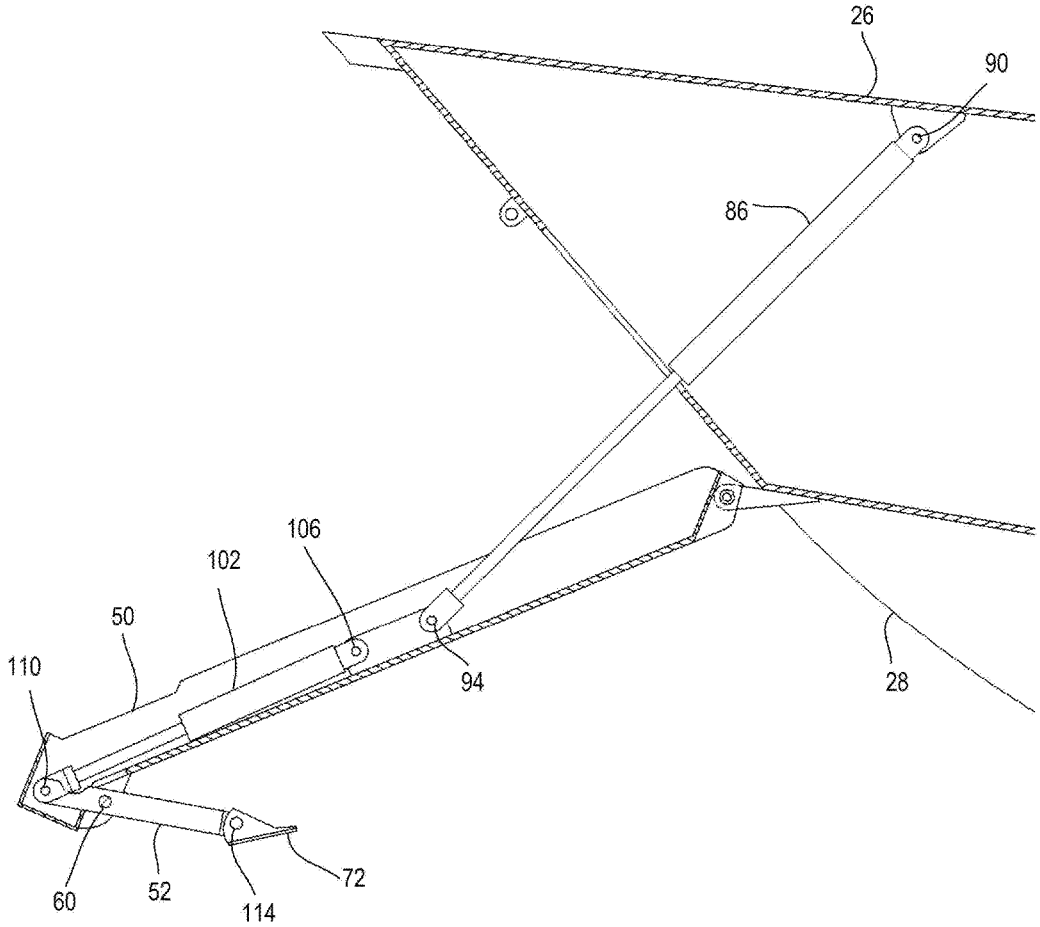
FIG. 12 is a side cutaway enlarged view of the example shown in FIG. 6.
Figure 13:
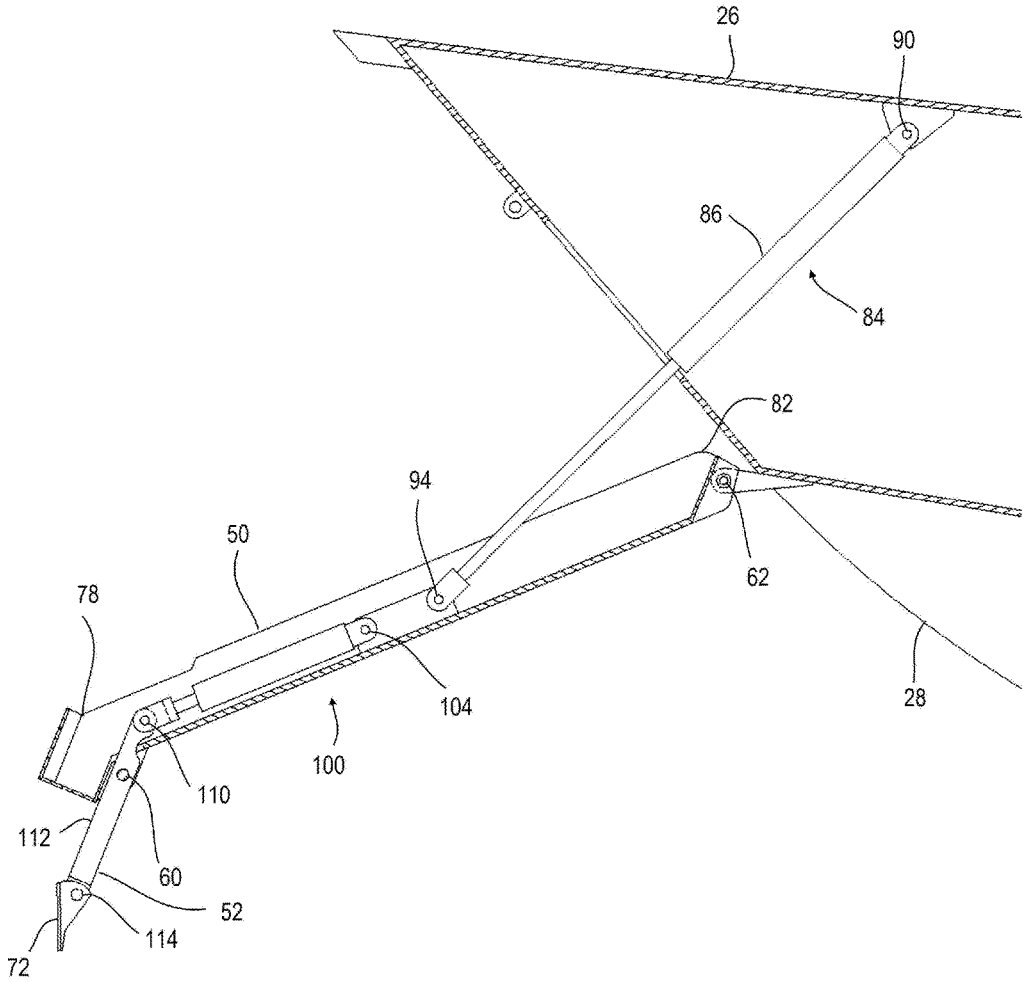
FIG. 13 is a side cutaway enlarged view of the example shown in FIG. 3.

Looking to FIG. 11 is shown a side cutaway view of one example of the door system and method for boats with the bow ramp 50 rotated about the bow ramp/hull pivot 62 at the proximal end 82 of the bow ramp 50 to a partially opened position 80, and the shore-penetrating spikes are shown nearly in a fully retracted position (see FIG. 6).

FIG. 11 also shows one example of a bow ramp lift mechanism 84. The bow ramp lift mechanism 84 of this example includes a user actuated mechanism configured to raise and lower the bow ramp 50 about the bow ramp/hull pivot 62. Commonly, the bow ramp 50 has significant weight and a substantial lever arm about the bow ramp/hull pivot 62, especially when formed of heavy construction for example extruded or sheet metals such as aluminum or steel. It may not be required that the bow ramp lift mechanism provide motive force to rotate the bow ramp to the open position as gravity may supply this force. In such an application, the bow ramp lift mechanism 84 may only be needed to reposition the bow ramp 50 upward, toward the closed position 64. While rotational devices such as rotational actuators, motors, engines, rack and pinion gear, etc. may be utilized, with or without connecting struts, an example is shown here utilizing a linear actuator 86. The linear actuator 86 may be a hydraulic actuator, pneumatic actuator, electric solenoid or equivalents. In this example, a first end 88 of the linear actuator 86 is attached to the hull 26 via a first actuator pivot 90, and a second end 92 of the linear actuator 86 is attached via a second actuator pivot 94 to the bow ramp 50. In this example, the linear actuator 86 comprises a cylinder 96 and an extending strut 98 which extends from the cylinder 96 as pressure or hydraulic fluid volume is increased within the cylinder 96. Generally, as a vacuum is formed in the cylinder 96, or as hydraulic fluid is withdrawn therefrom, the strut 98 will be withdrawn into the cylinder 96 thus raising the bow ramp 50. In a dual acting pneumatic or hydraulic cylinder, net positive pressure will be applied to a first end of the cylinder to extend the strut, and net positive pressure will be applied to a second end of the cylinder to retract the strut.

FIG. 11 also shows a shore-engaging spike rotation mechanism 100. While rotational devices such as rotational actuators, motors, engines, etc. may be utilized, an example is shown here utilizing a linear actuator 102. This linear actuator 102 may also be a hydraulic actuator, pneumatic actuator, electric solenoid, rack and pinion gear, or equivalent with or without connecting struts. In this example, a first end 104 of the linear actuator 102 is attached to the bow ramp 50 at a first actuator pivot 106 and the second end 108 is attached to the shore engaging spike 52 via a second actuator pivot 110. As shown, a bow ramp/spike pivot 60 is positioned on a leg 112 of the shore engaging spike 52 between the foot 72 and the second end 108 of the actuator 102. In other examples, the actuator pivot 110 is positioned between the bow ramp/spike pivot 60 and the foot 72. In this example, the linear actuator 102 comprises a cylinder and an extending strut which extends from or is pulled into the cylinder as pressure or hydraulic fluid volume is increased or decreased within the cylinder. Generally, as a vacuum is formed in the cylinder, or as hydraulic fluid is withdrawn therefrom, the strut will be withdrawn into the cylinder, and as pressure is increased in the cylinder, or as hydraulic fluid is pumped into the cylinder, the strut will be pushed out of the cylinder, both motions rotating the spike 52 in opposing rotational directions.

A numbering system is utilized herein where specific examples of a generic component include a specific indicator suffix. For example, the shore penetrating spikes are generally denoted as 52 as shown in FIG. 1 whereas the separate starboard and port shore penetrating spikes are denoted as 52*a* and 52*b* as shown in FIG. 9.

Can also be appreciated in FIG. 11 that the foot 72 may be attached to the leg 112 via a foot pivot 114. Looking to FIG. 9, it can be seen that the longitudinal width of each foot 72*a* and 72*b* is wider than the adjacent with of the shore engaging spike 52*a* and 52*b*.

The pivot 114 may comprise a removable pin, which allows removal and replacement of each foot 72 due to wear, damage, or where another design is desired.

FIG. 9 also shows a connection bar 116 extending laterally between legs 112 of the starboard shore engaging spike 52*a* and the port shore engaging spike 52*b* to provide additional rigidity to the structure and coordination of rotation.

FIG. 11 also shows a control conduit 118 extending between and connected to the bow ramp lift mechanism 84 such as the linear actuator 86, and a remote control or switch 120 which will commonly be housed within the hull 26 such as on or within the cockpit 32. In some applications, the remote control 120 will be attached to an interior surface 122 of the hull 26 near the bow ramp 50 as is shown in FIG. 9. This control conduit 118 may be electric signal conveying wires, hydraulic tubing, pneumatic tubing, or equivalents. In some applications the remote control 120 is directly operated by a user within the hull 26, while in other applications a wireless or wired user interface may be utilized directly by a user which controls circuitry or other control construction within the remote control 120. The control conduit 118 providing electric power, electric signals, hydraulic fluid, or a flow of pressurized gas to allow a user to remotely control the bow ramp lift mechanism 84 such as the linear actuator 86.

FIG. 11 also shows a control conduit 124 extending between the shore-engaging spike rotation mechanism 100 such as the spike rotation actuator 102 and the remote actuator 120. In one example, the remote actuator 120 may be separated into components operating independently each of the bow ramp lift mechanism 84 and the shore-engaging spike rotation mechanism 100. As discussed above relative to the bow ramp lift mechanism 84, in some applications, the remote control 120 will be attached to an interior surface 122 of the hull 26 near the bow ramp 50 as is shown in FIG. 9. This control conduit 118 may be electric signal conveying wires, hydraulic tubing, pneumatic tubing, or equivalents. In some applications the remote control 120 is directly operated by a user within the hull 26, while in other applications a wireless or wired user interface may be utilized directly by a user which controls circuitry or other control construction within the remote control 120. Two or more remote controls 120 may be provided to allow a single person to control movement of the ramp 50 from two locations or two people to control movement of the ramp 50. The control conduit 118 providing electric power, electric signals, hydraulic fluid, or a flow of pressurized gas to allow a user to remotely control the shore-engaging spike rotation mechanism 84 such as the linear actuator 86.

The remote actuator 120 allows the user to rotate the bow ramp 50 and the shore penetrating spikes 52 as described above to secure the vessel 24 relative to the shoreline 40, to move or crawl the vessel 24 up a shallow region of a seabed 46 or shore 42 to achieve a position where the bow ramp 50 may be effectively utilized, or to move or crawl the vessel 24 down a shallow region of a seabed 46 or shore 42 to achieve the depth at which the drive system 34 may be safely engaged.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

What is claimed is:

1. A door system for a boat, the system comprising:

a vessel having a hull configured to float on the surface of water, the hull comprising a bow and a stern;

the bow having a bow ramp having: a proximal end pivotably attached to the hull at a bow ramp/hull pivot, and a distal end having a bow ramp/spike pivot adjacent thereto;

a user-actuated bow ramp lift mechanism connected between the bow ramp and the hull, the bow ramp lift mechanism configured to mechanically manipulate the bow ramp about the bow ramp pivot from a closed position to an open position, to mechanically exert force upon the bow ramp in an upward and in a downward direction;

at least one spike pivotably attached to the bow ramp at the bow ramp/spike pivot;

a user-actuated spike rotation mechanism independently operable from the bow ramp lift mechanism, the spike rotation mechanism configured to mechanically manipulate the spike about the bow ramp/spike pivot in a forward and in a rearward direction; and a remote control actuator for each of the user-actuated bow ramp lift mechanism and the user-actuated spike rotation mechanism.

2. The door system as recited in claim 1 further comprising feet pivotably attached to each spike.

3. The door system as recited in claim 2 wherein the feet are removably attached to each spike.

4. The door system as recited in claim 1 wherein the user-actuated spike rotation mechanism configured to mechanically manipulate each spike about the bow ramp/spike pivot comprises a dual action hydraulic actuator.

5. The door system as recited in claim 1 wherein the user-actuated spike rotation mechanism configured to mechanically manipulate the spike about the bow ramp/spike pivot comprises a dual action pneumatic actuator.

* * * * *